US006357398B1

(12) United States Patent
Arakawa et al.

(10) Patent No.: US 6,357,398 B1
(45) Date of Patent: Mar. 19, 2002

(54) CONTROL SYSTEM FOR INTERNAL COMBUSTION ENGINE

(75) Inventors: Yoshinobu Arakawa; Kouji Sasaki; Yoshikazu Tsukada; Mitsugu Koike, all of Numazu (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 0 days.

(21) Appl. No.: 09/573,866

(22) Filed: May 18, 2000

(30) Foreign Application Priority Data

May 25, 1999 (JP) ..... 11-145299

(51) Int. Cl.[7] ..... F01L 13/02
(52) U.S. Cl. ..... 123/41 E; 123/41 R
(58) Field of Search ..... 123/41 R, 41 E, 123/631, 198 D, 198 DB; 701/114

(56) References Cited

U.S. PATENT DOCUMENTS 5,036,802 A * 8/1991 D'Amours ..... 123/41 E
5,782,210 A * 7/1998 Venturoli et al. ..... 123/41 E
5,964,191 A * 10/1999 Hata ..... 123/41 E

FOREIGN PATENT DOCUMENTS

| | | |
|---|---|---|
| JP | 11-82270 | 3/1999 |
| JP | 11-93718 | 4/1999 |
| JP | 11-93719 | 4/1999 |

* cited by examiner

*Primary Examiner*—Willis R. Wolfe
*Assistant Examiner*—Katrina B. Harris
(74) *Attorney, Agent, or Firm*—Pearne & Gordon LLP

(57) ABSTRACT

A control system for an internal combustion engine is provided for a running equipment, which prevents from running in the direction opposed to the driver's intention when reversing the engine is failed although a driver executes a reverse process of reversing the rotative direction of the engine. The rotative direction of the internal combustion engine is detected so as to generate a rotative direction detection signal, and a reverse failure signal is generated when the rotative direction of the engine detected by these detection signals does not correspond to the rotative direction of the engine commanded by a reverse command. When the reverse failure signal is generated, fuel supply to the engine is stopped, and the engine is extinguished so as to stop the rotation.

9 Claims, 7 Drawing Sheets

Fig. 4A
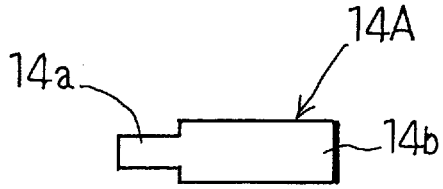
Fig. 4B
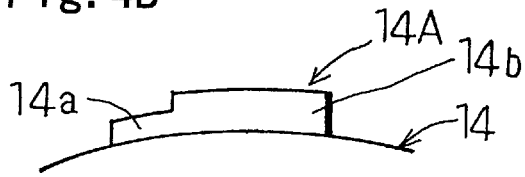
Fig. 5A
Fig. 5B
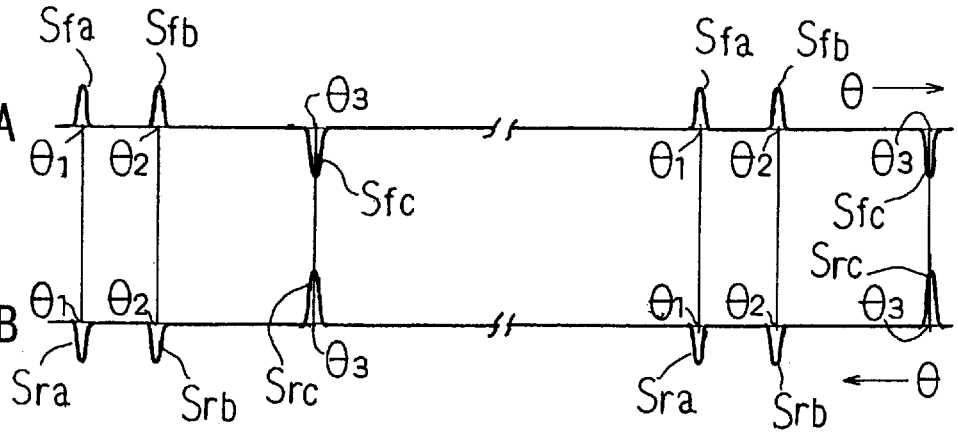

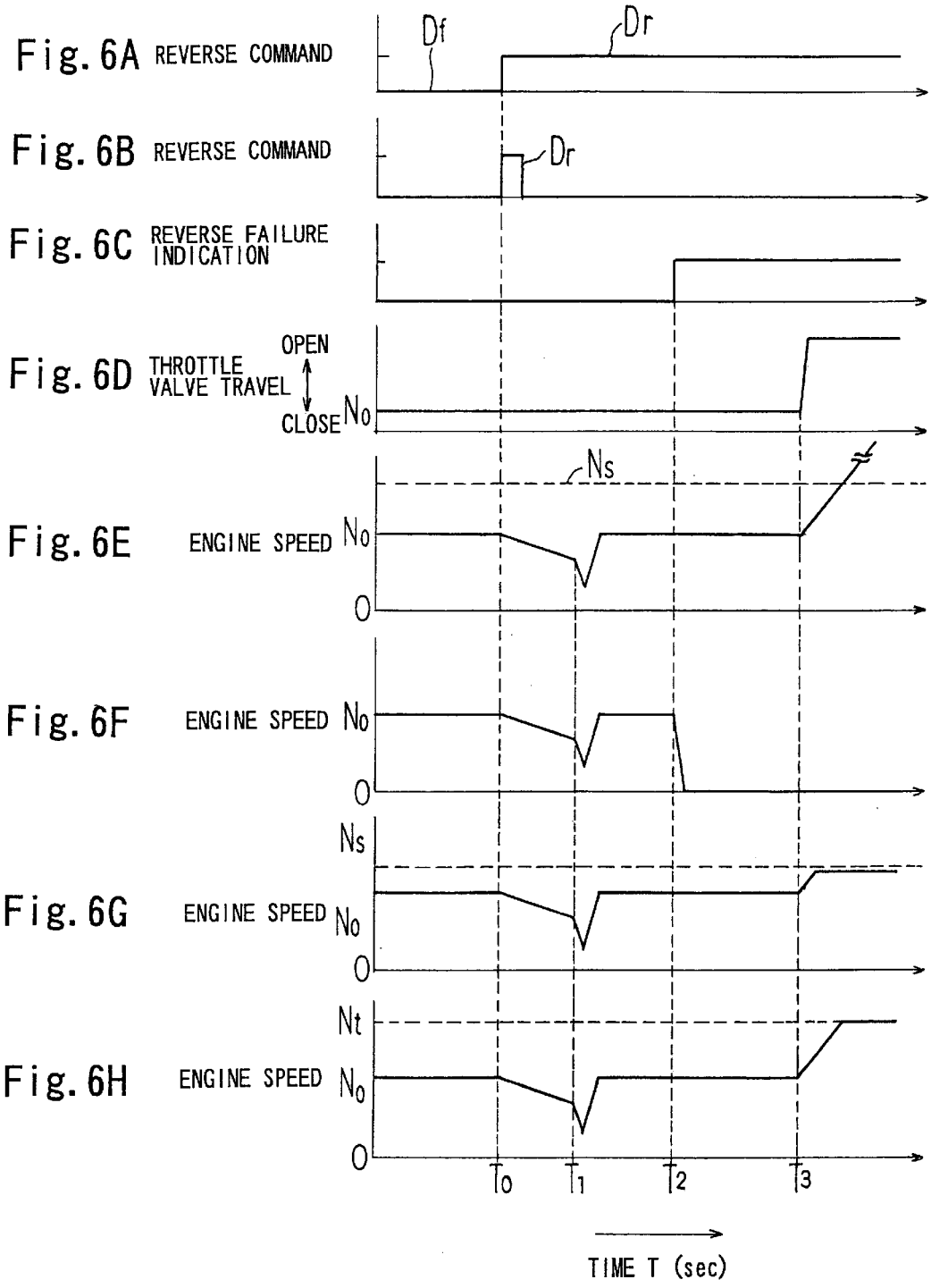
Fig. 6A REVERSE COMMAND
Df
Dr
Fig. 6B REVERSE COMMAND
Dr
Fig. 6C REVERSE FAILURE INDICATION
Fig. 6D THROTTLE VALVE TRAVEL
OPEN
CLOSE
No
Ns
Fig. 6E ENGINE SPEED
No
0
Fig. 6F ENGINE SPEED
No
0
Ns
Fig. 6G ENGINE SPEED
No
0
Nt
Fig. 6H ENGINE SPEED
No
0
T0
T1
T2
T3
TIME T (sec)

CONTROL SYSTEM FOR INTERNAL COMBUSTION ENGINE

FIELD OF THE INVENTION

The present invention relates to a control system for changing over the rotational direction of a two cycle internal combustion engine, according to a reverse command in order to switch the running direction of a running equipment (vehicle) such as a small size vehicle driven by the engine.

DESCRIPTION OF THE PRIOR ARTS

A small size two cycle internal combustion engine is generally used as a drive source for a running equipment such as a scooter, a snow mobile, and a buggy car which places importance on simplicity or convenience. Since this type of running equipment is required to be small, light weight, and inexpensive, a stepless transmission of a centrifugal clutch type (automatic power transmission means) which does not include a back gear is adopted as a power transmission means for transmitting an output of the internal combustion engine to a driving wheel of a running equipment.

Since a running equipment employing a transmission including no back gear cannot go backward by switching the transmission, it is necessary to lift the entire running equipment in order to change the direction when it is required to reverse a running direction in a narrow space, thereby it is highly deteriorated in operability.

In a case of operating a snow mobile, since it cannot go backward, it is difficult to get out of the situation when its tip becomes buried in the snow.

In order to switch the running direction of a vehicle employing a transmission having no back gear as described above, it may be thought to take a method by which the rotative direction of an internal combustion engine is reversed.

Specifically, since it is possible to rotate in both forward and reverse directions in a two cycle internal combustion engine and a normal operation can be executed even in the forward rotation or the reverse rotation, when a two cycle internal combustion engine is employed as an engine for driving a vehicle, it is possible to switch the running direction of the vehicle by switching the rotative direction of the internal combustion engine.

In a two cycle internal combustion engine, when an ignition position (a rotative angle position of a rotary crankshaft of the engine at the time of igniting the engine) is advanced to an excessively advanced position (a position further advanced than an allowable maximum advanced position of the ignition position at the time of steady operation) in the state in which the engine speed is sufficiently reduced by reducing the injection quantity and/or stopping the injection of fuel, it is possible to reverse the rotative direction of the engine by pushing back a piston which is moving to a top dead center inside a cylinder. Also, by setting the ignition position of the engine at a position suitable for normally maintaining the rotation to the reverse direction after the reversion of the rotative direction of the engine is confirmed, the operation of the internal combustion engine can be normally maintained in a state in which the rotative direction is reversed.

As shown in Japanese Patent Application Laid Open No. 11-82270, Japanese Patent Application Laid Open No. 11-93718, and Japanese Patent Application Laid Open No. 11-93719, a control system for an internal combustion engine is proposed, which the rotative direction of a two cycle internal combustion engine can be reversed according to a command of a driver in order to switch the running direction of a running equipment. In these proposed control systems, a reverse command which commands reversing the rotative direction of the internal combustion engine is generated by letting a driver manually operate a switch so as to reduce the injection quantity or stop the injection of fuel responding to the reverse command, and the engine speed of the internal combustion engine is reduced. Then, when the engine speed of the internal combustion engine is sufficiently reduced, the rotative direction of the engine is reversed by excessively advancing the ignition position of the engine to a further advanced position sufficiently beyond the top dead center of a piston.

However, even when the control described above is executed, reversing the rotative direction fails although it is rare. When reversing the rotative direction fails, if the driver executes an operation of accelerating the engine without knowing the failure, it is very dangerous since the running equipment suddenly runs in the direction opposite to the direction that the driver intends.

The present applicants have previously proposed a control system for an internal combustion engine having a means which may inform which direction the engine actually rotates and inform that reversing is failed after giving a reverse command as shown in Japanese Patent Application Laid Open No. 2000-97094. When this type of informative means is employed, a situation in which an engine is accelerated in a state in which a running equipment runs in the direction opposite to that a driver intends can be avoided, thereby bringing a preferable condition.

However, even when a control system for an internal combustion engine has such informative means, a driver may drive without actually confirming the rotative direction of the engine which the informative means informs. A driver may erroneously recognize the rotative direction of the engine which the informative means informs. A driver may not be able to confirm an actual rotative direction of the engine since an indicator or the like that is an informative means does not work well even though a reverse process is normally executed. In any cases, if an engine is rotated so that the running direction of a running equipment becomes different from the direction that a driver intends, driving is not safely executed.

SUMMARY OF THE INVENTION

The present invention has been made in view of the foregoing disadvantages of the prior. Accordingly, it is an object of the present invention to provide a control system for an internal combustion engine which can avoid a running equipment from running in the direction that a driver does not intend in the case in which reversing the rotative direction of the internal combustion engine is failed although a reverse command is given.

According to the present invention, a control system for an internal combustion engine is provided, which comprises a reverse command generating means generating a reverse command for switching a running direction of a running equipment driven by a two cycle internal combustion engine, a reverse processing means executing a reverse process necessary for reversing a rotative direction of the internal combustion engine based on the reverse command which is generated from the reverse command generating means, a rotative direction detection means generating rotation detection signals of which states are different at each time when the internal combustion engine is forwardly rotated and is reversely rotated and detecting the rotative direction of the internal combustion engine from a state of the rotation detection signal, a reverse failure determining means determining that reversing of the internal combustion engine is failed when the rotative direction detected by the rotative direction detection means does not correspond to the rotative direction commanded by the reverse command, and an internal combustion engine drive control means controlling the internal combustion engine so that running of the running equipment is prevented when the failure of the reversing of the rotative direction is determined by the reverse failure determining means.

In the present description, "running of the running equipment is prevented" means that making the running equipment not move, or if it moves, making it move only slowly.

As described above, by preventing the running equipment from running when the failure of reversing the rotative direction of the engine is determined, the running equipment may be prevented from suddenly starting running in the direction that a driver does not intend in a case in which the driver executes an operation for accelerating the engine without noticing the failure of reversing the rotative direction of the engine.

In the present description, "running equipment" is employed in the meaning including all running vehicles such as a scooter, a snow mobile, a buggy car, and a motorboat which uses a two cycle internal combustion engine as a drive source.

The said internal combustion engine drive control means may be an engine drive stop means stopping the drive of the internal combustion engine by executing either stopping an ignition operation of the internal combustion engine or stopping a supply of fuel to the internal combustion engine or by executing both stopping an ignition operation of the internal combustion engine and stopping a supply of fuel to the internal combustion engine.

The said internal combustion engine drive control means may be means restricting the engine speed, which maintains the engine speed of the internal combustion engine at a value lower than a minimum engine speed necessary for becoming a state in which an automatic transmission can transmit the motive power of the internal combustion engine to the running equipment.

The said internal combustion engine drive control means may be means controlling the internal combustion engine so that running speed of the running equipment is restricted to a slow speed when the failure of the reversing of the rotative direction is determined by the reverse failure determining means.

The said internal combustion engine drive control means may be a transmission system control means controlling the transmission system so that transmission of the motive power from the internal combustion engine to the running equipment is terminated when the failure of the reversing of the rotative direction is determined by the reverse failure determining means.

When reversing the rotative direction of the engine is failed, if only the engine is stopped and/or only the running speed of the running equipment is restricted to a slow speed, it is likely that a driver does not realize the failure in reversing the rotative direction of the engine. Accordingly, it is preferable to provide an informative means informing the reverse failure when the reverse failure determining means determines the reverse failure.

BRIEF DESCRIPTION OF THE DRAWINGS

FIG. 4A is a plan view showing a constitutional example of a reluctor which is a part of a rotor of a signal generating device constituting a rotative direction detection means.

FIG. 4B is a side elevational view showing another constitutional example of a reluctor which is a part of a rotor of a signal generating device constituting a rotative direction detection means.

FIG. 5A and FIG. 5B are waveform charts showing waveforms of signals that the signal generating device generates according to the rotation of an engine.

FIG. 6A to FIG. 6H are timing charts for explaining the operation of the control system for the internal combustion engine of FIG. 1.

DETAILED DESCRIPTION OF THE PREFERRED EMBODIMENTS

Figure 1:
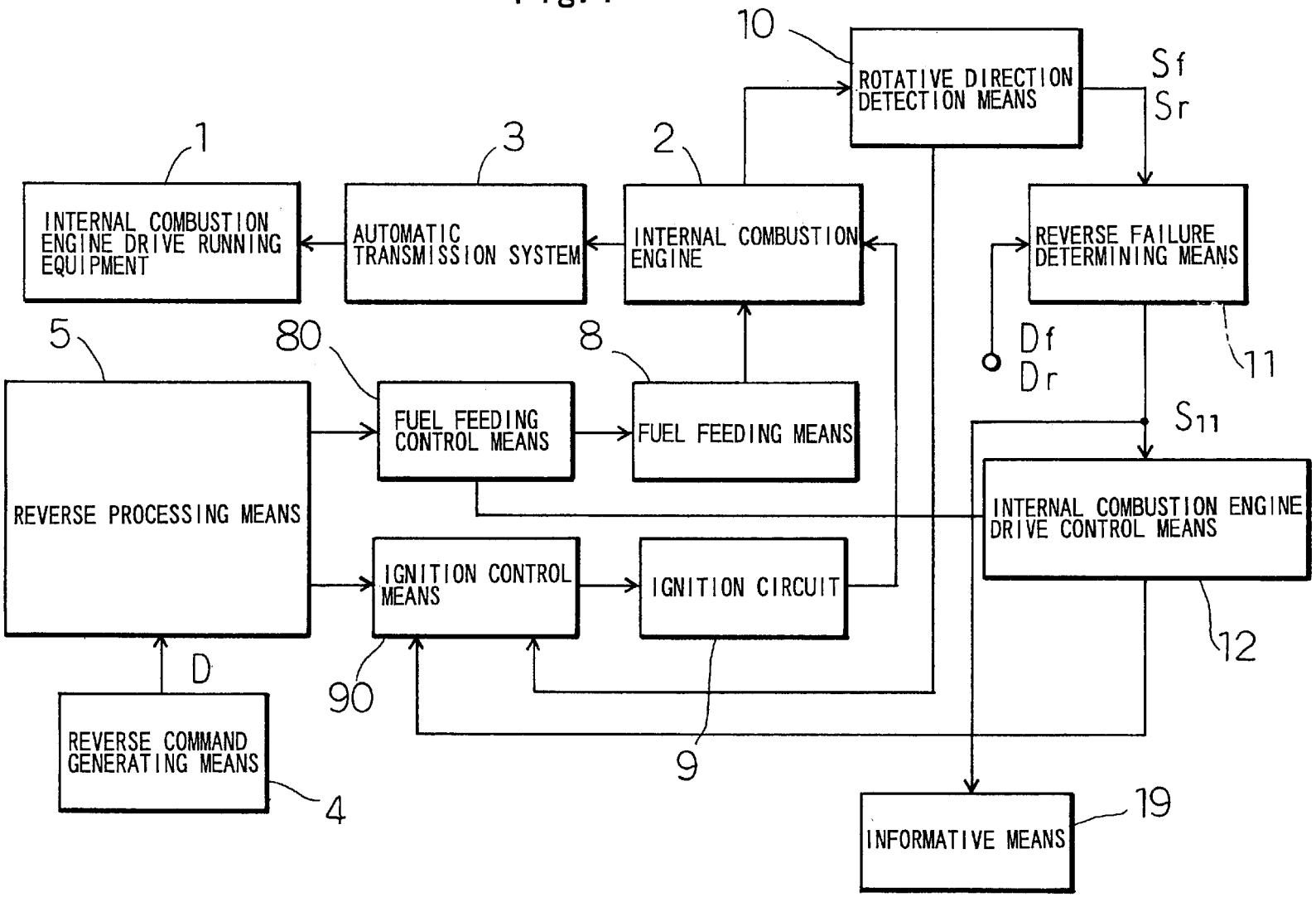
FIG. 1 is a block diagram showing an entire constitution of an embodiment according to the present invention.

FIG. 1 shows an entire constitution of an embodiment according to the present invention. The control system for the internal combustion engine shown in FIG. 1 may be applied to a two cycle internal combustion engine 2 which is arranged in a running equipment 1 such as a scooter and drives the running equipment 1. An automatic transmission system 3 such as a stepless transmission of a centrifugal clutch type which does not have a back gear is provided between a driven part of the running equipment 1 (for example, a driving wheel and a driving shaft of a screw) and an output shaft of the two cycle internal combustion engine 2. The automatic transmission system 3 terminates the transmission of motive power from the engine to the driven part of the running equipment when the engine speed is lower than a set value Ns and transmits the motive power of the engine to the driven part of the running equipment when the engine speed becomes the set value Ns or above. Usually, the set value Ns of the engine speed is set so as to be higher than an idling engine speed N0 of the engine.

The control system for the internal combustion engine according to the present invention is provided with a reverse command generating means 4 generating a reverse commend D commanding that the rotative direction of the two cycle internal combustion engine is reversed in order to switch the running direction of the running equipment 1 and a reverse processing means 5 executing a reverse process necessary for reversing the rotative direction of the internal combustion engine responding to the reverse commend D generated by the reverse command generating means 4.

Figure 2A:
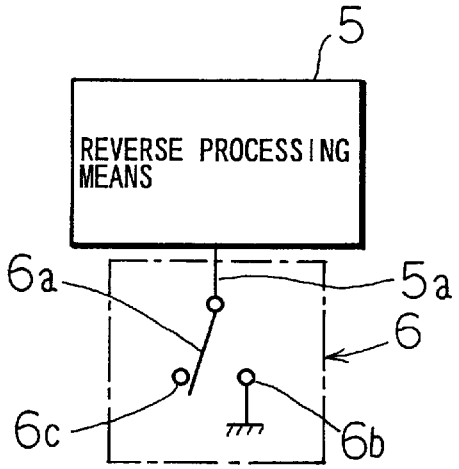
FIG. 2A is a block diagram showing a constitutional example of a reverse command generating means.

For example, as shown in FIG. 2A, the reverse command generating means 4 may be constituted of a self holding type switch (e.g., a toggle switch) 6 having a traveling contact 6*a* and fixed contacts 6*b* and 6*c*. The traveling contact 6*a* selectively comes in contact and maintains the state in which the traveling contact 6*a* comes in contact with either the fixed contact 6*b* or 6*c*. The reverse command generating means 4 may be constituted of a momentary switch (e.g., a pushbutton switch) 7 having a traveling contact 7*a*, fixed contacts 7*b*, 7*c*, and a spring 7*d* by which the traveling contact 7*a* is urged so as to be pulled apart from the fixed contacts 7*b*, 7*c*, which maintains a conductive state only when the traveling contact 7*a* is pressed to the fixed contacts 7*b*, 7*c* side as shown in FIG. 2B.

In the example shown in FIG. 2A, the traveling contact 6*a* is connected to an input line 5*a* of the reverse processing means 5, and only the fixed contact 6*b* among the fixed contacts 6*b*, 6*c* is grounded. Thus, depending on the situation as to whether the input line 5*a* of the reverse processing means is grounded (whether the traveling contact 6*a* is in contact with the fixed contact 6*b*) or is in a floating state on the ground (whether the traveling contact 6*a* is in contact with the fixed contact 6*c*), the reverse commend D (a forward command signal Df or a reverse command signal Dr) is given to the reverse processing means 5. In this case, the forward command signal and the reverse command signal given to the reverse processing means 5 are continuously generated signals as shown in FIG. 6A.

Figure 2B:
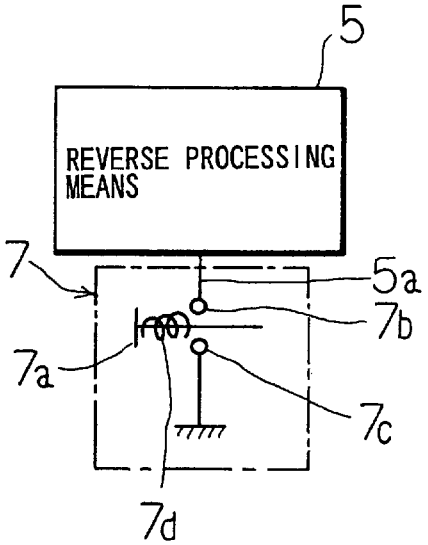
FIG. 2B is a block diagram showing another constitutional example of the reverse command generating means.

In the example shown in FIG. 2B, the fixed contact 7*b* and the fixed contact 7*c* are respectively connected to the input line 5*a* of the reverse processing means 5 and a ground circuit, and each time when the traveling switch 7*a* is pressed by means of a push button or the like so that the input line 5*a* is grounded (each time when the traveling contact 7*a* comes in contact with the fixed contact 7*b*, 7*c*), the reverse command D commanding that the rotative direction is reversed is given to the reverse processing means 5 (the forward command signal Df and the reverse command signal Dr are alternately given). In this case, the reverse command D given to the reverse processing means 5 is a pulse waveform signal as shown in FIG. 6B.

In the example shown in FIG. 1, a fuel feeding means 8 composed of an injector or the like is provided for feeding fuel to the internal combustion engine 2, and a fuel feeding control means 80 is provided for controlling the fuel feeding means 8. The fuel feeding control means 80 increases or decreases a quantity supplied of fuel to the internal combustion engine by controlling the fuel feeding means 8 and stops supplying fuel so as to increase or decrease the engine speed.

Further, in the example shown in FIG. 1, an ignition control means 90 is provided for controlling an ignition circuit 9 igniting the internal combustion engine, and a turning angle position at which the ignition circuit 9 executes an ignition operation is appropriately controlled by the ignition control means 90.

By means of the ignition control means 90, the ignition position is advanced to an excessively advanced position, taking an ignition control mode as an excessively advanced control mode when a reverse process reversing the rotative direction of the internal combustion engine 2 is executed, and the ignition position is controlled according to the engine speed within a predetermined range suitable for maintaining the rotation of the internal combustion engine, taking the ignition control mode as a steady control mode at the time of a steady operation of the internal combustion engine 2.

The reverse processing means 5 gives a command to the fuel feeding control means 80 so as to stop supplying fuel to the internal combustion engine or decrease the quantity supplied of fuel when the reverse command D (the forward command signal Df or the reverse command signal Dr) is given from the reverse command generating means 4 so that the engine speed of the internal combustion engine 2 is decreased to a low engine speed suitable for reverse. Then, the reverse processing means 5 recovers the quantity supplied of fuel to the internal combustion engine at the point where the engine speed is decreased to the engine speed suitable for reverse, and advances the ignition position of the engine to an excessively advanced position exceeding an advanced range of the time of the steady operation by giving a command to the ignition control means 90 so as to make the ignition control mode to the excessively advanced control mode so that the rotative direction of the engine is reversed.

When the rotative direction of the internal combustion engine 2 is reversed, a throttle valve is fully contracted as shown in FIG. 6D so that the internal combustion engine 2 is brought into an idling condition as shown in FIG. 6E. When the internal combustion engine 2 is rotated at the idling engine speed N0 lower than the set value Ns, the running equipment 1 is in a stopped state since the automatic transmission system 3 terminates the transmission of motive power from the internal combustion engine 2 to the running equipment 1.

As shown in FIG. 6A, at a time T0, when the reverse command generating means 4 generates the reverse command Dr, the reverse processing means 5 gives a command to the fuel feeding control means 80 so as to control the fuel feeding means 8 so that the supply of fuel to the internal combustion engine is stopped or the quantity supplied of fuel is decreased. Thus, the engine speed is decreased to an engine speed (the engine speed at which the rotative direction is reversed when the ignition position of the engine is excessively advanced) suitable for reverse of the rotative direction.

The reverse processing means 5 recovers the quantity supplied of fuel to the engine to the quantity at the time T0 when the engine speed is decreased to the engine speed suitable for reverse in the rotative direction at a time T1, and advances the ignition position of the engine to the excessively advanced position by giving a command to the ignition control means 90.

Since a piston of the engine 2 is pushed back before reaching to a top dead center when the ignition position is excessively advanced in a state in which the engine speed is sufficiently decreased, the rotative direction of the engine 2 may be reversed. The engine may be operated in a state in which the engine is rotated in the rotative direction by making the ignition position return to a normally advanced range after the rotative direction of the engine 2 is reversed.

FIG. 6E shows the change of the engine speed when the rotative direction is failed. In the example of the drawing, the ignition position is excessively advanced at the time T1 when the engine speed is reduced to the engine speed suitable for reverse, and thus the engine speed is sharply decreased so as to try to reverse the rotative direction. However, since reversing is failed by some reason, when the ignition position is returned from the excessively advanced position to a normally advanced range, the engine speed is returned to the idling engine speed. If a driver does not notice this state and opens the throttle valve at a time T3, the engine speed is increased and exceeds the set value Ns at which transmission of motive power by the automatic transmission system 3 is started as shown in the right side of FIG.

6E. Accordingly, the running equipment 1 starts running in the direction that the driver does not expect.

In order to solve the above described problem, the control system for the internal combustion engine in the present invention comprises a rotative direction detection means 10 generating rotation information detection signals which take different states for each time when the internal combustion engine 2 is forwardly and reversely rotated and detecting the rotative direction of the internal combustion engine 2 from the state of the rotation information detection signal, a reverse failure determining means 11 comparing the rotative direction detected by the rotative direction detection means 10 with the rotative direction that the reverse command generating means 4 commands and determining that reversing the rotative direction in the internal combustion engine 2 is failed when both directions do not correspond to each other, and an internal combustion engine drive control means 12 controlling the drive of the internal combustion engine 2 so that the running equipment 1 does not run or , even if it runs, runs slowly when the reverse failure determining means 11 determines the failure of reverse as shown in FIG. 1.

Figure 3:
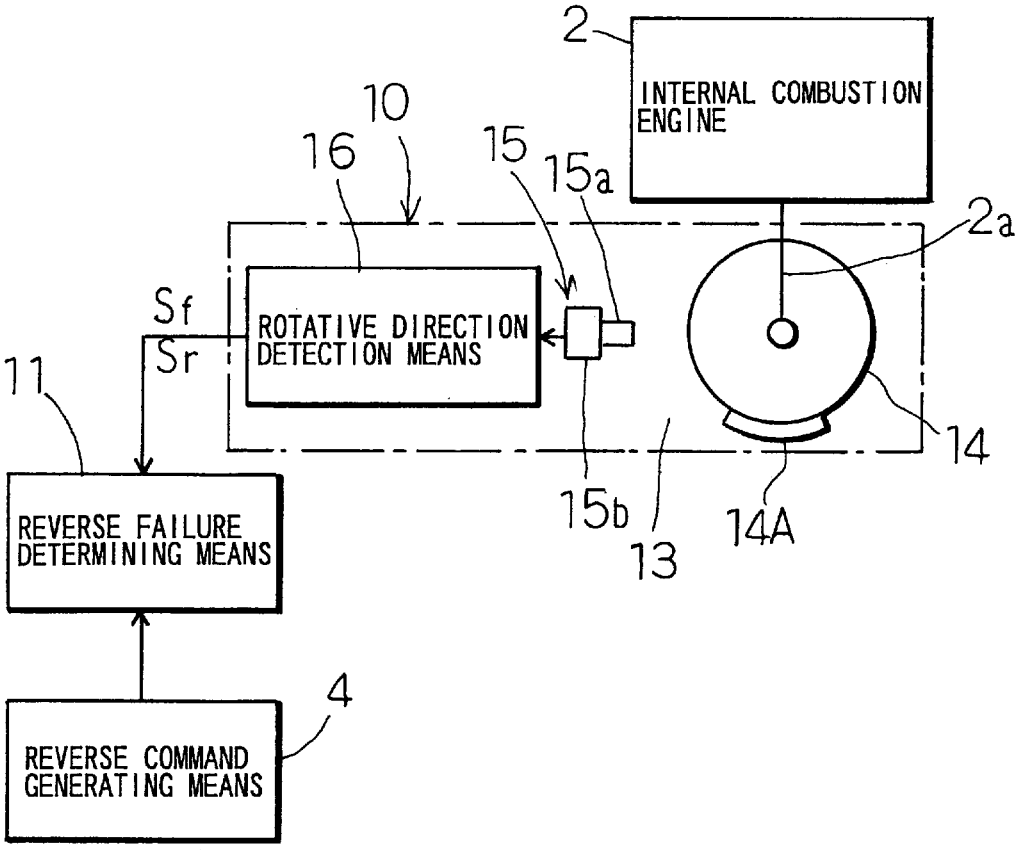
FIG. 3 is a block diagram showing the constitution of the main part of a control system for an internal combustion engine according to the present invention.

As shown in FIG. 3, for example, the rotative direction detection means 10 may be constituted of a signal generating device 13 driven by the internal combustion engine 2 and a rotative direction determining means 16 determining the rotative direction of the engine from the output the signal generating device.

The signal generating device 13 shown in the drawing is constituted of an inductor type rotor 14 attached to a crankshaft 2*a* of the internal combustion engine 2 and a signal generator 15 attached to a case or the like of the internal combustion engine 2.

In the drawing, a two step reluctor 14A is provided which shape changes in two steps along the rotative direction in an outer peripheral part of the rotor 14. The two step reluctor 14A may be constituted with a protrusion having a first portion 14*a* with a narrow width and a second portion 14*b* with a wider width than that of the first portion for example as shown in FIG. 4A, or may be constituted with a protrusion having a first portion 14*a* with a low height and a second portion 14*b* with a high height as shown in FIG. 4B.

The signal generator 15 is a well known one composed of an iron core 15*a* having a magnetic pole portion at its tip, a signal coil 15*b* wound around the iron core 15*a,* and a permanent magnet (not shown) magnetically coupled with the iron core 15*a,* and fixed on the case or the like of the engine in a state in which the magnetic pole portion of the tip of the iron core 15*a* is directed to the outer periphery of the rotor 14.

FIG. 5A and FIG. 5B respectively show, relative to the rotation angle θ of the crankshaft, waveforms of signals that the signal coil 15*b* of the signal generator 15 generates when the rotor 14 (crankshaft) is forwardly rotated and when the rotor 14 is reversely rotated.

That is, in the process in which the engine is forwardly rotated, the signal coil 15*b* generates pulses Sfa and Sfb of one polarity (the positive polarity in the example shown in the drawing) when the magnetic pole portion of the tip of the iron core 15*a* starts facing the first portion 14*a* of the two step reluctor 14A and starts facing the second portion 14*b* of the two step reluctor 14A, respectively, as shown in FIG. 5A, and generates a pulse Sfc of the other polarity (the negative polarity in the example shown in the drawing) when the magnetic pole portion finishes facing the second portion 14*b*.

In the process in which the engine is reversely rotated, the signal coil of the signal generator 15 generates a pulse Src of one polarity (the positive polarity) when the magnetic pole portion of the tip of the iron core 15*a* starts facing the second portion 14*b* of the two step reluctor 14A and starts facing the first portion 14*a* of the two step reluctor 14A respectively as shown in FIG. 5B, and generates pulses Srb, Sra of the other polarity (the negative polarity) when the magnetic pole portion of the tip of the iron core 15*a* starts facing the first portion 14*a* and finishes facing the first portion 14*a,* respectively.

The signal generating device 13 generates the pulse signals different from each other in their polarities and generating order when the internal combustion engine 2 rotates in the forward direction and rotates in the reverse direction. Thus, the rotative direction of the engine can be known by employing these pulses as rotation information signals (the rotation information detection signal) and distinguishing the polarity of the pulses and the generating order.

The rotative direction detection signals obtained from the signal generating device 13 is given to the rotative direction determining means 16. The rotative direction determining means 16 judges the rotative direction of the engine from the polarity and the generating order of a series of pulses given from the signal generating device 13 and generates a forward rotation detection signal Sf and a reverse rotation detection signal Sr when the judged rotative direction is in the forward direction and in the reverse direction, respectively. The rotative direction detection means is comprised of the signal generating device 13 and the rotative direction determining means 16. The forward rotation detection signal Sf and the reverse rotation detection signal Sr obtained from the rotative direction detection means are given to the reverse failure determining means 11.

The pulses generated in the signal generating device 13 are also given to the ignition control means 90. The ignition control means 90 detects the engine speed of the engine 2 from generation interval of specific pulses generated in the signal generating device 13, for example, from the generation interval between the pulse Sfa and Sfc, and calculates the ignition timing relative to the detected engine speed when an operation mode is in a steady operation mode so as to give an ignition signal to the ignition circuit 9 at the time of ignition in question. The ignition circuit 9 generates a spark at an ignition plug attached to a cylinder of the engine when the ignition signal is given so as to ignite the engine.

The reverse failure determining means 11 shown in FIG. 3 compares the reverse command signals Df, Dr that the reverse command generating means 4 generates with the rotative direction detection signal Sf, Sr and judges that reversing the rotative direction is failed when the rotative direction of the engine commanded by the reverse command differs from the rotative direction detected by the rotative direction detection means 10, thereby generating a reverse failure signal S11.

The judgement by the reverse failure determining means 11 is executed when the time needed usually to complete reverse of the rotative direction is passed (time T2 shown in FIG. 6) after the reverse command generating means 4 generates the reverse commend D (Df or Dr).

When the reverse failure determining means 11 generates the reverse failure signal S11, the internal combustion engine drive control means 12 shown in FIG. 1 controls the internal combustion engine 2 or controls the transmission system provided between the internal combustion engine and the running equipment 1 so that the running equipment 1 does not run or even if it runs, its running speed does not increase to or beyond a slow speed of the extent that the safety of a driver is not threatened (preferably the speed is extremely slow and of a minimum necessary for making the driver physically feel the failure in reversing the rotative direction of the engine).

In order not to run the running equipment when reversing the rotative direction is failed, drive of the internal combustion engine 2 may be stopped, or the engine speed of the internal combustion engine may be restricted at a value (e.g., the idling engine speed N0) lower than the minimum value (the set value Ns shown in FIG. 6E) of the engine speed which the automatic transmission system 3 needs in order to transmit the motive power of the engine to the running equipment 1 so that the automatic transmission system 3 does not transmit the rotation of the engine to the driven part of the running equipment 1.

In order to stop the internal combustion engine when the failure of reversing the rotative direction is detected, a stop command may be given from the control means 12 to the fuel feeding control means 80 so as to stop the drive of the fuel feeding means 8 by the control means 80, or an ignition stop command commanding stop of the ignition operation of the internal combustion engine 2 may be given to the ignition control means 90 so as to stop the ignition operation of the ignition circuit 9, when the reverse failure signal S11 is given to the internal combustion engine drive control means 12.

Stopping the engine may be executed by executing the stop of supply of fuel to the internal combustion engine and the stop of the ignition operation at the same time.

In order to prevent the running speed of the running equipment from being increased to or beyond a slow set speed through which a driver is not harmed when reversing the rotative direction is failed, for example, when the reverse failure signal is generated, a fuel restriction command may be given from the internal combustion engine drive control means 12 to the fuel feeding control means 80 so as to restrict the quantity of the fuel that the fuel feeding means 8 gives to the engine so that even if the driver executes an operation of opening of a throttle valve, the engine speed does not increase to or beyond a set speed.

In the control system for the internal combustion engine in the present invention, an informative means 19 is provided for informing the failure of reversing when the reverse failure determining means 11 generates the reverse failure signal S11 so that the informative means is operated when the reverse failure signal is generated at the time T2 as shown in FIG. 6C.

In the control system for the internal combustion engine as shown in FIG. 1, in a case in which the internal combustion engine drive control means 12 is constituted so as to stop the engine when reversing the rotative direction of the engine is failed, when failure in reversing the rotative direction is detected at the time T2, the engine is quickly stopped as shown in FIG. 6F. Therefore, even when a driver erroneously opens the throttle valve at the time T3, the engine is maintained in a state in which it is kept stopping.

In a case in which the internal combustion engine drive control means 12 is constituted so as to restrict the engine speed to a value lower than the engine speed Ns at which a centrifugal clutch is connected when that reversing the rotative direction is failed is detected at the time T2, after reversing the rotative direction is failed, the engine speed is maintained at the idling engine speed NO as shown in FIG. 6G. When a driver opens the throttle valve at the time T3, although the engine speed increases, the running equipment is maintained in a state in which it is kept stopping since the engine speed is controlled so as not to reach the set value Ns.

Further, in the case in which the running speed of the running equipment is restricted to or below a sufficiently low speed Nt of the extent that the driver is not harmed when reversing the rotative direction is failed, although the engine speed increases when the driver opens the throttle at the time T3, it does not exceed the set speed Nt as shown in FIG. 6H. At this time, although the running equipment runs at a slow speed, the safety of the driver may be ensured since the running speed is restricted to or below the sufficiently low speed Nt through which a driver is not harmed. In the case like this constitution, since the driver may physically feel that reversing the rotative direction is failed by the movement of the running equipment, an operation for giving the reverse command again may be executed quickly.

As described above, when the informative means 19 is provided for the engine drive control means 12, reverse of the rotative direction may be commanded once again since a driver can recognize that reversing the rotative direction is failed by the operation of the informative means 19. In addition, when the informative means 19 is provided, in a case in which reverse of the rotative direction is failed so that the running equipment 1 is stopped and/or in which accelerating becomes impossible, such state may not be erroneously recognized as a breakdown of the engine or a breakdown of a motive power system of the running equipment, thereby bringing an advantage.

The informative means 19 may employ a luminescent indicator such as a lamp and a light emitting diode, a sounding device such as a buzzer, or both these elements.

Also, the informative means 19 may be constituted so as not only to indicate the reverse failure but also to indicate different states for each actual rotative direction of the internal combustion engine 2.

The above-described reverse processing means 5, the fuel feeding control means 80, the ignition control means 90, the rotative direction determining means 16 of the rotative direction detection means 10, and the ignition control means 90 may be realized by executing a predetermined program in a microcomputer.

Figure 7:
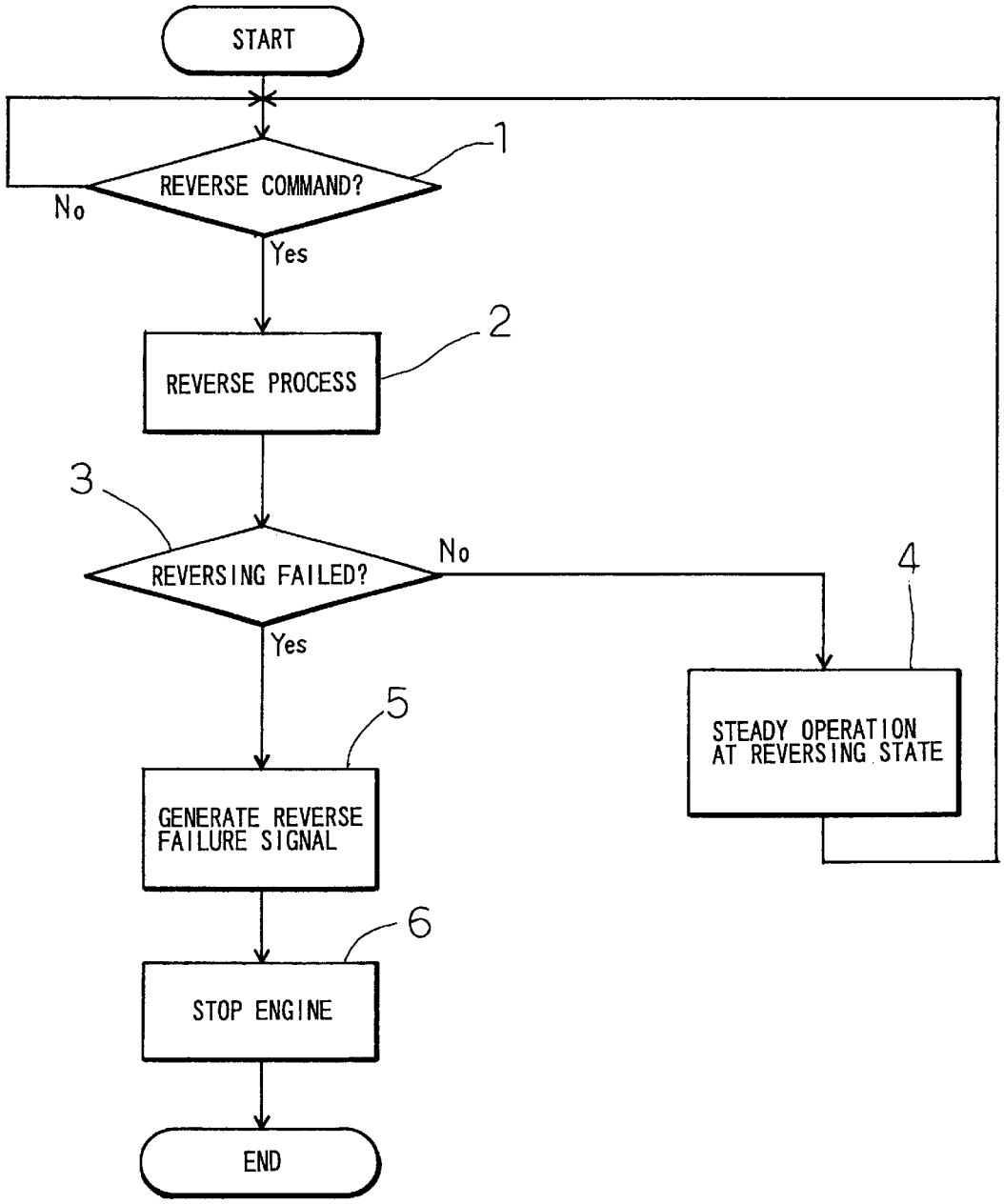
FIG. 7 is a flowchart showing an example of an algorithm of a program that a microcomputer executes in a control system for an internal combustion engine according to the present invention.
Figure 8:
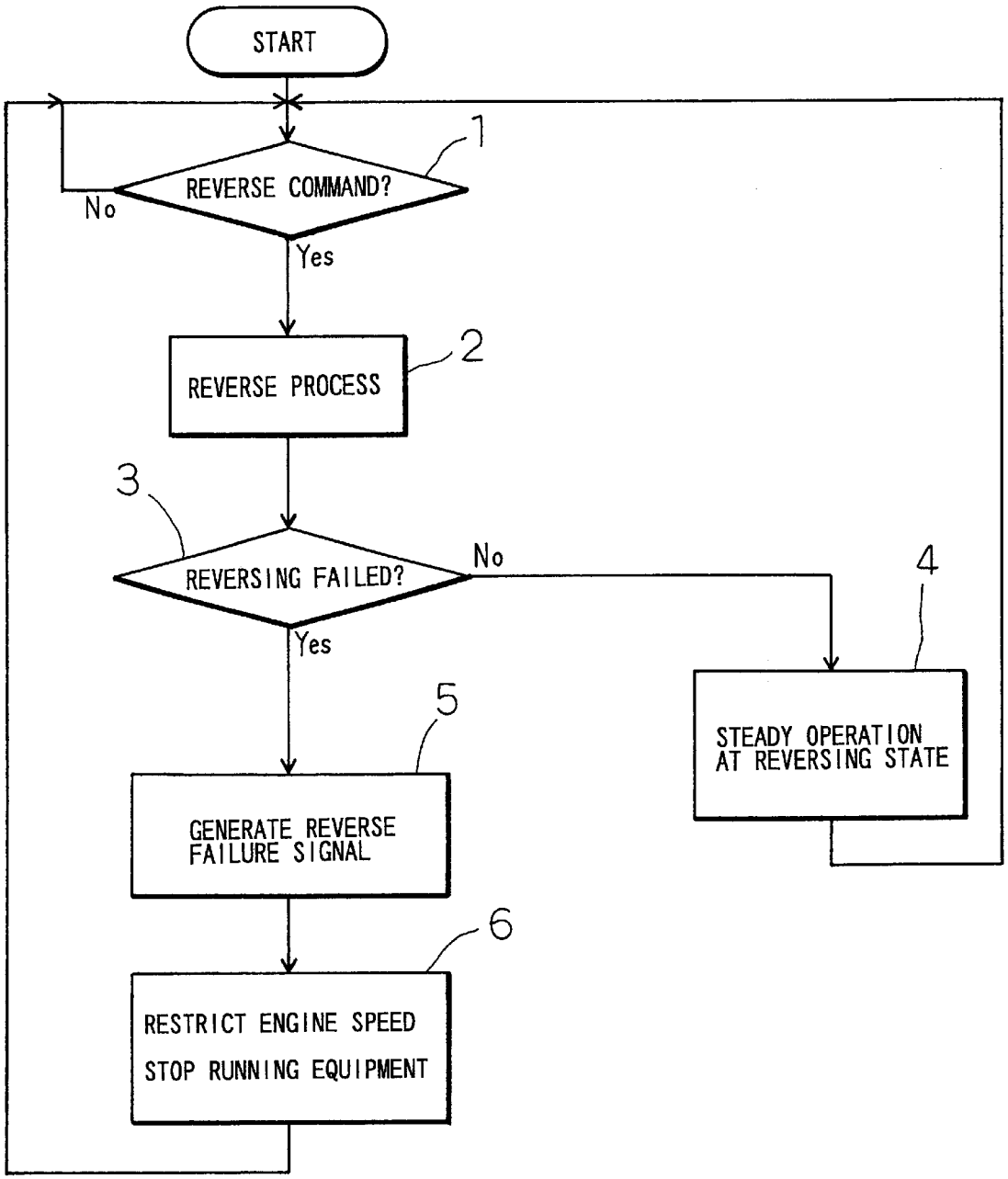
FIG. 8 is a flowchart showing another example of an algorithm of a program that a microcomputer executes in a control system for an internal combustion engine according to the present invention.
Figure 9:
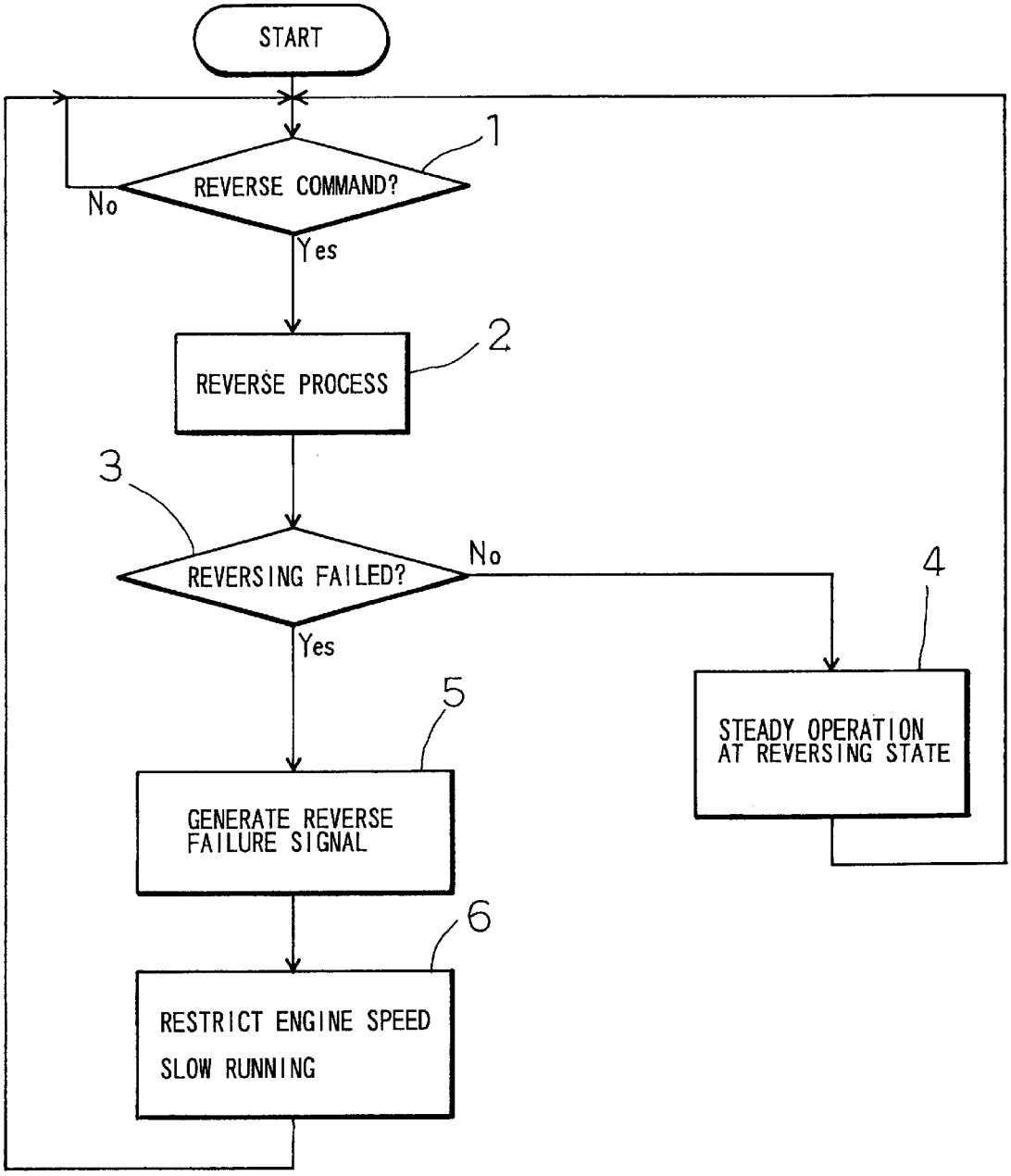
FIG. 9 is a flowchart showing still another example of an algorithm of a program that a microcomputer executes in a control system for an internal combustion engine according to the present invention.

FIG. 7 to FIG. 9 show various kinds of examples of flowcharts showing algorithms of programs executed by the microcomputer when each means described above is implemented, employing the microcomputer.

In the example shown in FIG. 7, it is determined at Step 1 whether the reverse command is given or not, and when the reverse command is given, the reverse process is executed after shifting to Step 2. In this reverse process, the engine speed is decreased by stopping the supply of fuel to the internal combustion engine and/or stopping the ignition operation of the internal combustion engine, and when the engine speed is decreased to a value at which reversing is possible, the ignition operation is executed at the excessively advanced position so as to reverse the rotative direction of the engine.

After the reverse process is executed, it is determined at Step 3 whether or not reversing is failed is determined at Step 3. As a result, when reversing is successful, Step 3 proceeds to Step 4. At Step 4, the ignition circuit 9 is controlled by the ignition control means 90 so that the ignition position of the engine comes to a position suitable for the steady operation in the state in which the rotative direction is reversed so as to execute the steady operation in the state in which the rotative direction is reversed, and then Step 4 returns to Step 1. At Step 3, when the failure of the reversing the rotative direction is determined, Step 3 proceeds to Step 5 so as to generate the reverse failure signal S11. Next, at Step 6, the engine is stopped by stopping the supply of fuel by the fuel feeding means 8 and/or stopping the ignition operation by the ignition circuit 9.

In the example shown in FIG. 8, at Step 5 the reverse failure signal is generated, and then at Step 6 the supply of fuel to the engine and/or the ignition timing of the engine is controlled so that the engine speed is restricted to a value lower than the set engine speed Ns that is the engine speed at which the a centrifugal clutch is connected. In this way, the transmission of motive power from the internal combustion engine to the running equipment is terminated so as to stop the running equipment. In FIG. 8, other steps are similar to the example shown in FIG. 7.

In the example shown in FIG. 9, the reverse failure signal is generated at Step 5, and then, at Step 6, the quantity supplied of fuel to the internal combustion engine and/or the ignition timing of the engine are controlled in order to restrict the engine speed so that the running speed of the running equipment is restricted to a slow speed (to or below a sufficiently low speed at which there is no fear that a driver is harmed). Thus, the running equipment may be run at an excessively slow speed at which there is no fear that a driver is harmed (preferably a speed of a minimum necessary for making the driver physically feel that the running equipment is trying to run in the direction opposite to that the driver intends). Other points are similar to the examples shown in FIG. 7 and FIG. 8.

In the examples described above, although the automatic transmission system with the centrifugal clutch is employed as the transmission system provided between the internal combustion engine and the running equipment, the present invention may be applied to cases in which a torque converter type automatic transmission system which does not have a back gear or a manual switch type transmission system which does not have a back gear is employed. In a case in which the torque converter type automatic transmission system is employed, in order to prevent the running speed of the running equipment without stopping the internal combustion engine at the time of reverse failure, a torque converter may be switched to a neutral position when the reverse failure is detected.

In a case in which the manual switch type transmission system is employed, in order to prevent the running of the running equipment without stopping the engine, for example, a magnetic clutch may be inserted in the transmission system between the crankshaft of the internal combustion engine and the driven part of the running equipment so that the magnetic clutch may be opened when reversing the rotative direction of the internal combustion engine is failed.

As described above, according to the present invention, in a case in which reversing the rotative direction of the internal combustion engine is failed by some causes although the driver operates so as to generate the reverse command, running of the running equipment is prevented by stopping the engine or restricting the engine speed to a value lower than the engine speed at which the transmission system is connected. Therefore, it is possible to prevent the generation of accident caused by the running of the running equipment in the direction opposite to that the driver intended.

Further, according to the present invention, in a case in which reversing the rotative direction of the internal combustion engine is failed by some causes although the driver operates so as to generate the reverse command, in a case in which the running speed of the running equipment is restricted to or below a slow speed, when the driver executes an accelerating operation by opening an accelerator valve after operating so as to reverse the rotative direction of the engine, it is possible to restrict the running speed of the running equipment to a slow speed. Therefore, there is an advantage that not only may the protection of the driver be achieved, but also that reversing the rotative direction of the engine is failed may be sensed by making the driver physically feel that the running equipment slowly moves in the direction opposite to that the driver intends without harming the driver.

What is claimed is:

1. A control system for an internal combustion engine comprising:

a reverse command generating means generating a reverse command for switching a running direction of a running equipment driven by a two cycle internal combustion engine, a reverse processing means executing a reverse process necessary for reversing a rotative direction of the internal combustion engine in response to the reverse command that the reverse command generating means generates, a rotative direction detection means generating rotation detection signals of which states are different at each time when the internal combustion engine is forwardly and reversely rotated and detecting the rotative direction of the internal combustion engine from a state of the rotation detection signal, a reverse failure determining means determining the failure of reversing of the internal combustion engine when the rotative direction detected by the rotative direction detection means does not correspond to the rotative direction commanded by the reverse command, and an internal combustion engine drive control means controlling the internal combustion engine so that running of the running equipment is prevented when the failure of reversing of the rotative direction is determined by the reverse failure determining means.

2. A control system for an internal combustion engine according to claim 1, wherein the control system further comprises an informative means informing the reverse failure when the reverse failure determining means determines the reverse failure.

3. A control system for an internal combustion engine according to claim 1, wherein the internal combustion engine drive control means is composed of an engine drive stop means stopping the drive of the internal combustion engine.

4. A control system for an internal combustion engine according to claim 1, wherein the internal combustion engine drive control means is composed of an engine drive stop means which stop the drive of the internal combustion engine by executing either stopping an ignition operation of the internal combustion engine or stopping a supply of fuel to the internal combustion engine or by executing both stopping an ignition operation of the internal combustion engine and stopping a supply of fuel to the internal combustion engine.

5. A control system for an internal combustion engine according to claim 1, wherein the internal combustion engine drive control means is composed of an engine speed restriction means controlling so that an automatic transmission system automatically transmitting motive power from the internal combustion engine to the running equipment maintains the engine speed of the internal combustion engine at a set value lower than an engine speed necessary for becoming a state in which the motive power of the internal combustion engine is transmitted to the running equipment.

6. A control system for an internal combustion engine comprising:

a reverse command generating means generating a reverse command for switching a running direction of an internal combustion engine drive running equipment driven by a two cycle internal combustion engine and running, a reverse processing means executing a reverse process necessary for reversing a rotative direction of the internal combustion engine based on the reverse command that the reverse command generating means generates, a rotative direction detection means generating rotation detection signals of which states are different at each time when the internal combustion engine is forwardly and reversely rotated and detecting the rotative direction of the internal combustion engine from a state of the rotation detection signal, a reverse failure determining means determining that reversing of the internal combustion engine is failed when the rotative direction detected by the rotative direction detection means does not correspond to the rotative direction commanded by the reverse command generating means, and an internal combustion engine drive control means controlling the internal combustion engine so that running speed of the running equipment is restricted to a slow speed when the failure of reversing of the rotative direction is determined by the reverse failure determining means.

7. A control system for an internal combustion engine according to claim 6, wherein the control system further comprises an informative means informing the reverse failure when the reverse failure determining means determines the reverse failure.

8. A control system for an internal combustion engine comprising:

a reverse command generating means generating a reverse command for switching a running direction of an internal combustion engine drive running equipment running in such a way that motive power of a two cycle internal combustion engine is transmitted to a driven part via a transmission system, a reverse processing means executing a reverse process necessary for reversing a rotative direction of the internal combustion engine based on the reverse command that the reverse command generating means generates, a rotative direction detection means generating rotation detection signals of which states are different at each time when the internal combustion engine is forwardly and reversely rotated and detecting the rotative direction of the internal combustion engine from a state of the rotation detection signal, a reverse failure determining means determining the failure of reversing of the internal combustion engine when the rotative direction detected by the rotative direction detection means does not correspond to the rotative direction commanded by the reverse command, and a transmission system control means controlling the transmission system so that transmission of the motive power from the internal combustion engine to the running equipment is cut when the failure of reversing of the rotative direction is determined by the reverse failure determining means.

9. A control system for an internal combustion engine according to claim 8, wherein the controller further comprises an informative means informing the reverse failure when the reverse failure determining means determines the reverse failure.

* * * * *